US010676916B2

(12) United States Patent
Floe

(10) Patent No.: US 10,676,916 B2
(45) Date of Patent: Jun. 9, 2020

(54) TILTING CANOPY

(71) Applicant: Wayne Floe, McGregor, MN (US)

(72) Inventor: Wayne Floe, McGregor, MN (US)

( * ) Notice: Subject to any disclaimer, the term of this patent is extended or adjusted under 35 U.S.C. 154(b) by 0 days.

(21) Appl. No.: 16/103,924

(22) Filed: Aug. 14, 2018

(65) Prior Publication Data

US 2019/0048576 A1 Feb. 14, 2019

Related U.S. Application Data

(60) Provisional application No. 62/545,198, filed on Aug. 14, 2017.

(51) Int. Cl.

| | |
|---|---|
| ***E04B 1/344*** | (2006.01) |
| ***B63B 17/02*** | (2006.01) |
| ***E04H 6/00*** | (2006.01) |
| ***E04H 15/16*** | (2006.01) |
| ***E04H 15/32*** | (2006.01) |
| *E04H 15/00* | (2006.01) |
| *B63C 5/02* | (2006.01) |

(52) U.S. Cl.

CPC ..... *E04B 1/344* (2013.01); *B63B 17/02* (2013.01); *E04H 6/00* (2013.01); *E04H 15/16* (2013.01); *E04H 15/32* (2013.01); *B63C 5/02* (2013.01); *E04H 15/00* (2013.01)

(58) Field of Classification Search

CPC ..... E04H 15/00; E04H 15/16; E04H 15/18; E04H 15/008; E04H 15/32; E04H 15/60; E04H 15/36; E04H 6/00; B63B 17/02; B63B 2737/00; E04B 1/344; B63C 5/02; B63C 3/06

USPC ..... 135/114, 157, 158, 159, 152, 154, 94, 135/160, 97, 906, 908, 155; 114/263, 114/361, 44, 45, 51; 52/66, 79.5; 206/321

See application file for complete search history.

(56) References Cited

U.S. PATENT DOCUMENTS

| | | | | |
|---|---|---|---|---|
| 2,708,346 | A * | 5/1955 | Smith | B63C 1/00 405/3 |
| 3,083,540 | A * | 4/1963 | Smith | E02C 5/00 405/3 |
| 4,312,157 | A * | 1/1982 | Hertel | A01G 9/242 52/13 |
| 5,058,946 | A * | 10/1991 | Faber | B60P 3/1041 114/361 |
| 5,185,972 | A * | 2/1993 | Markiewicz | E04H 15/58 135/121 |
| 10,059,412 | B1 * | 8/2018 | Basta | B66F 7/0641 |
| 2001/0052356 | A1 * | 12/2001 | Ross | E04H 6/44 135/124 |

(Continued)

*Primary Examiner* — Robert Canfield
*Assistant Examiner* — Matthew J Gitlin

(57) ABSTRACT

A tilting canopy has a canopy frame, at least one actuator, a plurality of canopy supports, and a support frame. The canopy frame is hingedly connected to the support frame through two medial supports, such that the medial supports act as pivot points for the canopy frame. The at least one actuator is engaged between the canopy frame and the support frame such that the at least one actuator is configured to rotate the canopy frame about the pivot point between a lowered position and a raised position. In the raised position, a user may store a boat or other vehicle or item with towers, Bimini tops, or other features which would normally be prohibitive of moving the boat or other vehicle beneath the canopy.

8 Claims, 3 Drawing Sheets

(56) References Cited

U.S. PATENT DOCUMENTS

| | | | | |
|---|---|---|---|---|
| 2005/0016438 | A1* | 1/2005 | Hey | B63C 5/00 114/361 |
| 2005/0252542 | A1* | 11/2005 | Basta | B63C 5/00 135/156 |
| 2014/0026804 | A1* | 1/2014 | Templeton | B63B 17/02 114/361 |
| 2018/0251196 | A1* | 9/2018 | Craig | B63B 17/02 |

* cited by examiner

TILTING CANOPY

The current application claims a priority to the U.S. Provisional Patent application Ser. No. 62/545,198 filed on Aug. 14, 2017.

FIELD OF THE INVENTION

The present invention relates generally to a tilting canopy. More specifically, the present invention is a canopy which can be used with, but is not limited to, a boat lift, which can be raised and lowered to accommodate taller boats and other vehicles or transportable items.

BACKGROUND OF THE INVENTION

Many boaters use canopies to cover their boats while not in use. This prevents damage from sunlight and other weather elements. However, these canopies are not suitable for covering taller watercraft or watercraft with towers and Bimini tops. Boaters would either need to have the canopy excessively high in the air or need to remove their towers and Bimini tops in order to fit their boats under a canopy. It is therefore an objective of the present invention to introduce a device which can raise and lower a canopy to accommodate taller watercraft or watercraft with towers and Bimini tops.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a tilting canopy for a boat lift which can be raised and lowered with the use of an actuator. This allows the present invention to accommodate taller boats or boats with towers and Bimini tops. The back side, or entry side, of the present invention lifts and tilts upward to allow watercraft to enter underneath the canopy.

Figure 1:
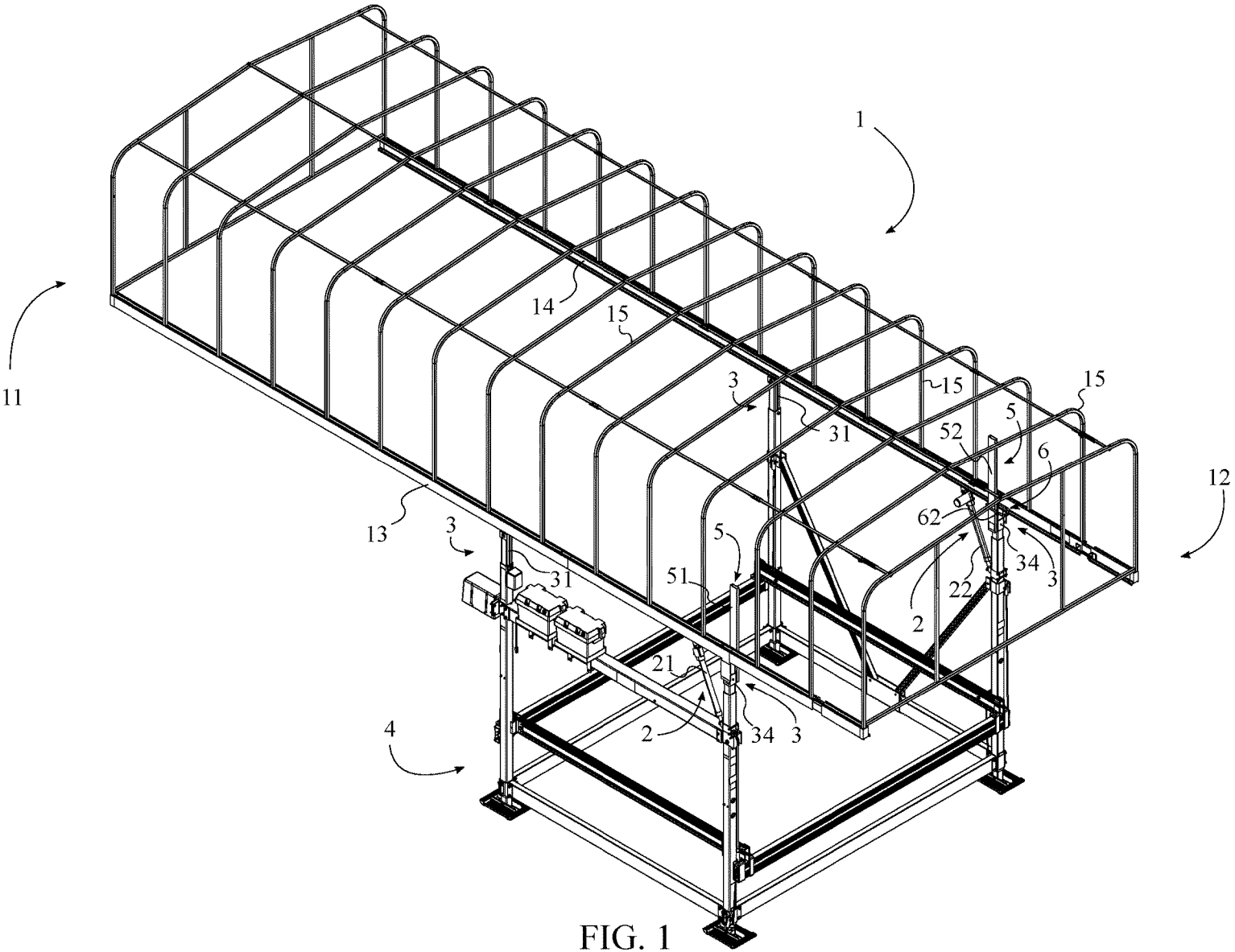
FIG. 1 is a left perspective view of the present invention in the lowered position in use with a boat lift as the support frame.
Figure 2:
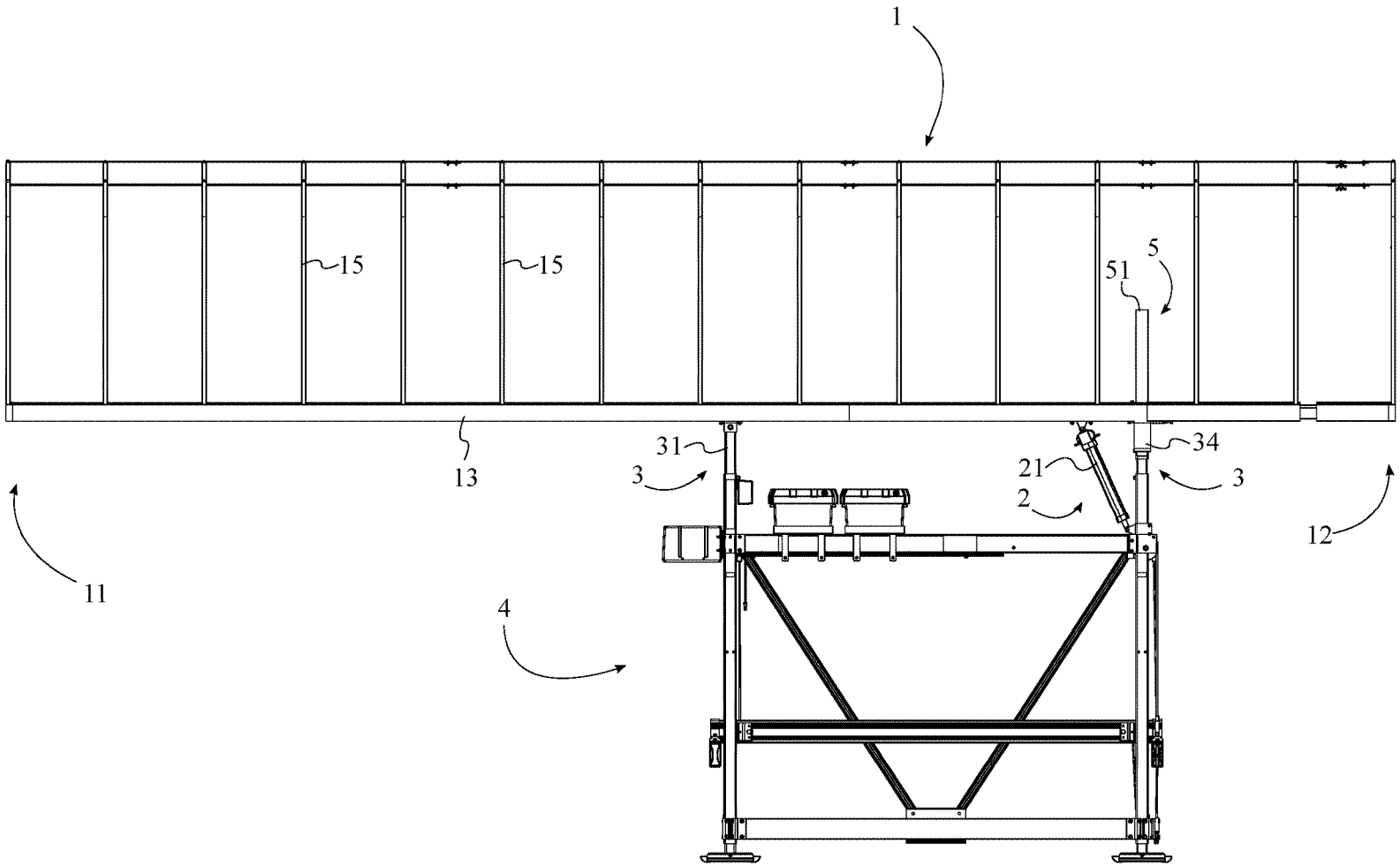
FIG. 2 is a left side view of the present invention in the lowered position in use with a boat lift as the support frame.
Figure 3:
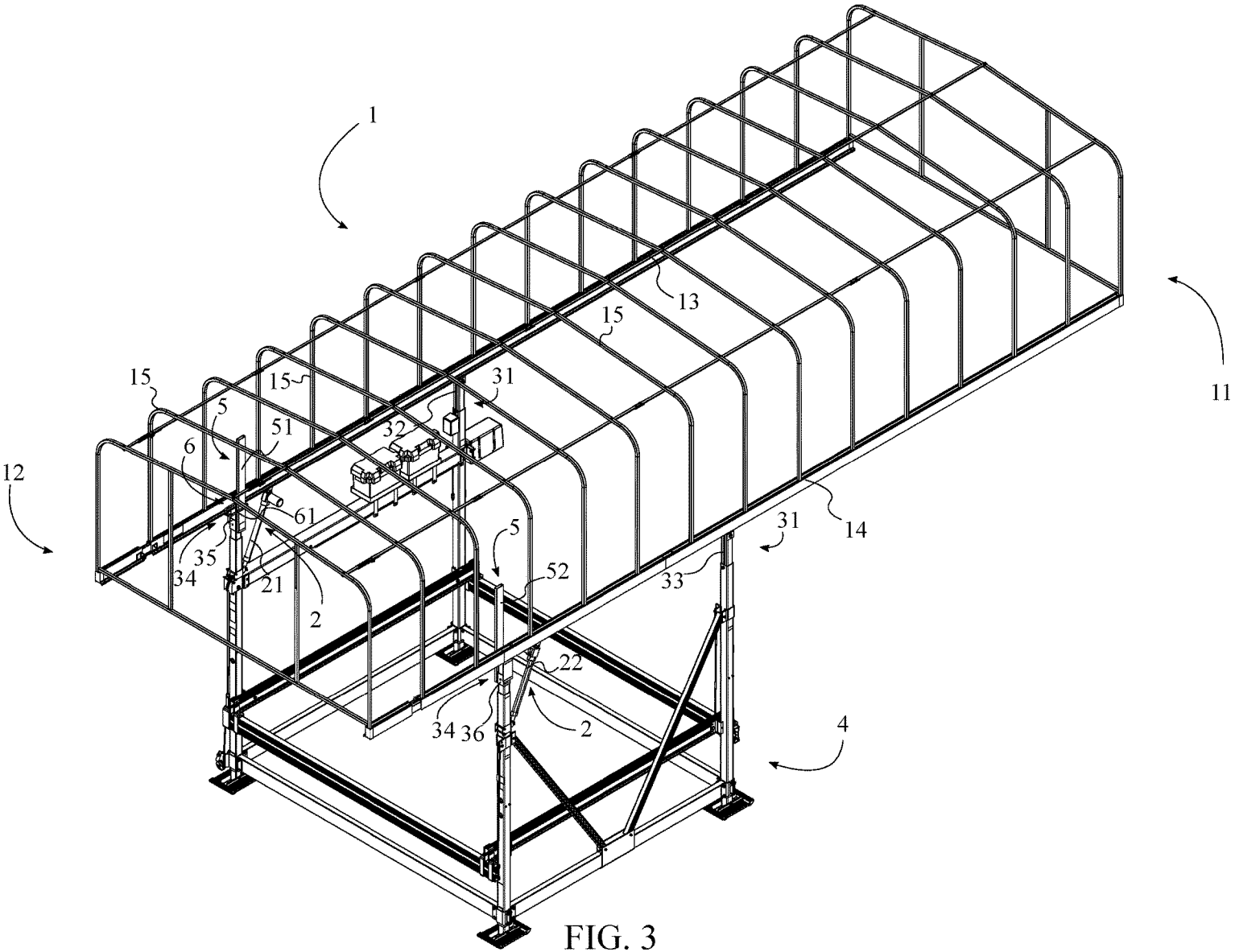
FIG. 3 is a right perspective view of the present invention in the lowered position in use with a boat lift as the support frame.

In general, referring to FIGS. 1-3, the present invention comprises a canopy frame 1, at least one actuator 2, a plurality of canopy supports 3, and a support frame 4. The canopy frame 1 comprises a proximal end 11 and a distal end

12, with the canopy frame 1 extending between the proximal end 11 and the distal end 12. The proximal end 11 may be understood to be the "shore side" of the canopy frame 1, while the distal end 12 is the "water side" or entry side of the canopy frame 1 in instances where the present invention is incorporated with a boat lift. Various fabric covers or covers comprising other relevant materials may be installed on the canopy frame 1 in order to protect any boats disposed underneath the canopy from the elements. The at least one actuator 2 is used to effect the tilting motion of the canopy frame 1. The plurality of canopy supports 3 holds the canopy frame 1 above the support frame 4. The support frame 4 may vary in different embodiments, and should be understood for the purposes of the present invention to serve the general purpose of structural support of the canopy frame 1 and various other components. In the preferred embodiment, the support frame 4 is a boat lift frame. For the purposes of the current disclosure, the support frame 4 may be understood to be generally rectangular, with four vertical corner posts, structural members connecting the corner posts, and a boat lift system mechanically engaged with the support frame 4 to vertically raise and lower a boat. The present invention was designed to be used in conjunction with a boat lift; however, it should be made clear that the present invention should not be limited for use with boat lifts and may be utilized for any other applicable purpose for a tilting canopy.

In the preferred embodiment of the present invention, the canopy frame 1 is connected to the support frame 4 through at least one of the plurality of canopy supports 3. Preferably, the plurality of canopy supports 3 comprises at least one medial support 31. Each of the at least one medial support 31 is connected to the support frame 4, and the canopy frame 1 is pivotally connected to each of the at least one medial support 31 opposite the support frame 4, such that the at least one medial support 31, or more particularly the connection point between the at least one medial support 31 and the canopy frame 1, is configured to act as a pivot point of the canopy frame 1. Each of the at least one actuator 2 is operatively engaged between the canopy frame 1 and the support frame 4 between the at least one medial support 31 and the distal end 12, wherein each of the at least one actuator 2 is configured to rotate the canopy frame 1 about the pivot point between a lowered position and a raised position. In the preferred embodiment of the present invention, each of the at least one actuator 2 is a linear actuator, and each of the at least one actuator 2 is configured to lift the distal end 12 of the canopy frame 1 away from the boat frame by applying an extending force between the support frame 4 and the canopy frame 1. It is contemplated that in various other embodiments, one or more of the at least one actuator 2 may comprise a different mechanism than a linear actuator; for example, the at least one actuator 2 may be a rotational actuator.

In some embodiments, the canopy frame 1 further comprises a first canopy rail 13, a second canopy rail 14, and a plurality of canopy members 15. The first canopy rail 13 and the second canopy rail 14 are oriented parallel to each other and extend between the proximal end 11 and the distal end 12. Each of the plurality of canopy members 15 is terminally connected between the first canopy rail 13 and the second canopy rail 14 between the proximal end 11 and the distal end 12, and preferably are equally spaced apart from each other, forming a frame for supporting a canopy cover.

In the preferred embodiment, the at least one actuator 2 comprises a first actuator 21 and a second actuator 22, and the at least one medial support 31 comprises a first medial support 32 and a second medial support 33, as seen in FIG.

3. The first actuator 21 is pivotally connected between the support frame 4 and the first canopy rail 13, and the second actuator 22 is pivotally connected between the support frame 4 and the second canopy rail 14. More particularly, in the preferred embodiment, a first end of the first actuator 21 and second actuator 22 is pivotally connected to the support frame 4, while a second end of the first actuator 21 is pivotally connected to the first canopy rail 13 and a second end of the second actuator 22 is pivotally connected to the second canopy rail 14. Thus, the actuators are capable of rotation relative to the canopy frame 1 and the support frame 4, but constrained by the relative movement of the canopy frame 1 and the support frame 4. Furthermore, the first canopy rail 13 is pivotally connected to the first medial support 32 opposite the support frame 4, and the second canopy rail 14 is pivotally connected to the second medial support 33 opposite the support frame 4. In the preferred embodiment, for example, a hinge mount is connected to each of the canopy rails, to which the medial supports are hingedly connected.

In the preferred embodiment of the present invention, the plurality of canopy supports 3 further comprises at least one distal support 34. Preferably, each of the at least one distal support 34 is connected to the boat frame adjacent to one of the at least one actuator 2, wherein the canopy frame 1 rests atop the at least one distal support 34 in the lowered position. However, it is contemplated herein that the position of each of the at least one distal support 34 is not necessarily restricted to being adjacent to one of the at least one actuator 2, and may be located at any desirable point between the at least one medial support 31 and the distal end 12 of the canopy frame 1.

In the preferred embodiment, the at least one distal support 34 comprises a first distal support 35 and a second distal support 36, as seen in FIG. 3. The first distal support 35 is connected to the support frame 4 adjacent to the first actuator 21, wherein the first canopy rail 13 rests atop the first distal support 35 in the lowered position. Similarly, the second distal support 36 is connected to the support frame 4 adjacent to the second actuator 22, wherein the second canopy rail 14 rests atop the second distal support 36 in the lowered position.

Furthermore, the preferred embodiment comprises at least one vertical guide member 5 and at least one vertical guide receiver 6. The at least one vertical guide member 5 is connected to one of the at least one distal support 34 opposite the support frame 4, and the at least one vertical guide receiver 6 is connected to the canopy frame 1. Each of the at least one vertical guide member 5 is positioned through one of the one of the at least one vertical guide receiver 6. The purpose of the vertical guide member is to assist maintaining stability during raising and lowering of the canopy, and to ensure proper alignment of the canopy frame 1 in relation to the support frame 4. Since the vertical guide member is constrained within the vertical guide receiver, the canopy frame 1 is constrained against lateral motion during normal use. In some embodiments, each of the at least one vertical guide receiver 6 is a loop of material, such as, but not limited to, a loop of metal, or alternatively, a metal or plastic plate with a hole through which the vertical guide member traverses.

More particularly, in the preferred embodiment, the at least one vertical guide member 5 comprises a first vertical guide member 51 and a second vertical guide member 52, while the at least one vertical guide receiver 6 comprises a first vertical guide receiver 61 and a second vertical guide receiver 62. The first vertical guide member 51 is connected to the first distal support 35 opposite the support frame 4, and the second vertical guide member 52 is connected to the second distal support 36 opposite the support frame 4. The first vertical guide receiver 61 is connected to the canopy frame 1 adjacent to the first actuator 21, and the second vertical guide receiver 62 is connected to the canopy frame 1 adjacent to the second actuator 22. More particularly, in some embodiments, the first vertical guide receiver 61 is connected to the first canopy rail 13, and the second vertical guide receiver 62 is connected to the second canopy rail 14. In some embodiments, the first vertical guide receiver 61 and the second vertical guide receiver 62 are connected to an interior of the canopy frame 1. The first vertical guide member 51 is positioned through the first vertical guide receiver 61, and the second vertical guide member 52 is positioned through the second vertical guide receiver 62. Thus, as the canopy frame 1 tilts between the raised position and the lowered position, the first vertical guide receiver 61 moves upward along the first vertical guide member 51, and the second vertical guide receiver 62 moves upward along the second vertical guide member 52.

The present invention may further comprise one or more canopy rail guides. Each canopy rail guide is connected to one of the canopy rails with fasteners and assists in maintaining the position of the canopy frame 1 on the canopy legs. This is especially useful when there are heavy winds that may cause the canopy to sway back and forth.

Furthermore, it is desirable for the present invention to have wireless connectivity capabilities. A wireless remote can be used to raise and lower the canopy from a distance. Once the canopy is raised, the watercraft can drive under the canopy and it will lower itself.

Although the invention has been explained in relation to its preferred embodiment, it is to be understood that many other possible modifications and variations can be made without departing from the spirit and scope of the invention as hereinafter claimed.

What is claimed is:

1. A tilting canopy comprising:

a canopy frame comprising a proximal end and a distal end, wherein the canopy frame extends between the proximal end and the distal end;

at least one actuator;

a plurality of canopy supports;

a support frame;

the canopy frame being connected to the support frame through at least one of the plurality of canopy supports;

the plurality of canopy supports comprising at least one medial support;

the at least one medial support being connected to the support frame;

the canopy frame being pivotally connected to the at least one medial support opposite the support frame, wherein the at least one medial support is configured to act as a pivot point of the canopy frame;

each of the at least one actuator being operatively engaged between the canopy frame and the support frame between the at least one medial support and the distal end, wherein each of the at least one actuator is configured to rotate the canopy frame about the pivot point between a lowered position and a raised position;

at least one vertical guide member; and the at least one vertical guide member being directly connected to one of the plurality of canopy supports opposite the support frame.

2. The tilting canopy as claimed in claim 1 comprising:
each of the at least one actuator being a linear actuator; and
each of the at least one actuator being configured to lift the distal end of the canopy frame away from the support frame.

3. The tilting canopy as claimed in claim 1 comprising:
the canopy frame comprising a first canopy rail, a second canopy rail and a plurality of canopy members;
the first canopy rail and the second canopy rail being oriented parallel to each other;
the plurality of canopy members being terminally connected between the first canopy rail and the second canopy rail;
the at least one actuator comprising a first actuator and a second actuator;
the at least one medial support comprising a first medial support and a second medial support;
the first actuator being pivotally connected between the support frame and the first canopy rail;
the second actuator being pivotally connected between the support frame and the second canopy rail;
the first canopy rail being pivotally connected to the first medial support opposite the support frame; and
the second canopy rail being pivotally connected to the second medial support opposite the support frame.

4. The tilting canopy as claimed in claim 1 comprising:
at least one distal support; and
each of the at least one distal support being connected to the canopy frame adjacent to one of the at least one actuator.

5. The tilting canopy as claimed in claim 1 comprising:
a first distal support;
a second distal support;
the first distal support being connected to a first canopy rail of the canopy frame adjacent to a first actuator of the at least one actuator; and
the second distal support being connected to a second canopy rail of the canopy frame adjacent to a second actuator of the at least one actuator.

6. The tilting canopy as claimed in claim 1 comprising:
at least one vertical guide receiver;
the at least one vertical guide receiver being directly connected to the canopy frame; and
each of the at least one vertical guide member being positioned through one of the at least one vertical guide receiver.

7. The tilting canopy as claimed in claim 6 comprising:
the at least one vertical guide member comprising a first vertical guide member and a second vertical guide member;
the at least one vertical guide receiver comprising a first vertical guide receiver and a second vertical guide receiver;
the first vertical guide member being connected to a first canopy support of the plurality of canopy supports opposite the support frame;
the second vertical guide member being connected to a second canopy support of the plurality of canopy supports opposite the support frame;
the first vertical guide receiver being connected to the canopy frame adjacent to the first actuator;
the second vertical guide receiver being connected to the canopy frame adjacent to the second actuator;
the first vertical guide member being positioned through the first vertical guide receiver; and
the second vertical guide member being positioned through the second vertical guide receiver.

8. The tilting canopy as claimed in claim 1 comprising:
the support frame being a boat lift frame.

* * * * *